US006413105B2

(12) United States Patent
Noro et al.

(10) Patent No.: US 6,413,105 B2
(45) Date of Patent: Jul. 2, 2002

(54) LEVER-TYPE CONNECTOR

(75) Inventors: Yutaka Noro; Hajime Kawase; Yutaka Kobayashi, all of Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 09/852,564

(22) Filed: May 10, 2001

(30) Foreign Application Priority Data

May 16, 2000 (JP) ..... 2000-142966

(51) Int. Cl.[7] ..... H01R 13/62
(52) U.S. Cl. ..... 439/157
(58) Field of Search ..... 439/157, 159, 439/160, 372

(56) References Cited

U.S. PATENT DOCUMENTS 5,445,530 A * 8/1995 Inoue et al. ..... 439/157
5,681,175 A * 10/1997 Busse et al. ..... 439/157
5,938,458 A * 8/1999 Krehbiel et al. ..... 439/157
6,120,308 A * 9/2000 Hayashi ..... 439/157

FOREIGN PATENT DOCUMENTS

JP 3-4672 1/1991

* cited by examiner

*Primary Examiner*—Gary Paumen
*Assistant Examiner*—Ann McCamey
(74) *Attorney, Agent, or Firm*—Anthony J. Casella; Gerald E. Hespos

(57) ABSTRACT

A cover (50) is installed on a rear side of a female housing (21) of a female connector (20) to be fitted on a male connector (10). A shaft hole (73) of a lever (70) is fit on a shaft (51) that projects from a front end of the cover (50). Thus the lever (70) can be rotated around the shaft (51). The lever (70) has a cam groove (74) that engages a follower pin (17) of the male connector (10). The follower pin (17) penetrates into the cam groove 74 with the rotation of the lever (70). A lever accommodation portion (40) is formed on upper and lower walls of a female-side hood part (23). The lever (70) is accommodated in the lever accommodation portion (40), and is sandwiched between a wall (41) and an accommodation wall (42) without forming a gap therebetween. A reinforcing wall (43) connects a front end of the wall (41) and that of the accommodation wall (42) to each other.

8 Claims, 18 Drawing Sheets

LEVER-TYPE CONNECTOR

BACKGROUND OF THE INVENTION

1. Field of the Invention

The present invention relates to a lever-type connector.

2. Description of the Related Art

A lever-type connector is disclosed in Japanese Utility Model Application Laid-Open No. 3-4672. This lever-type connector includes a female housing with opposite front and rear ends and upper and lower walls that extend between the front and rear ends. The upper and lower walls each have an outer surface. Upper and lower plates extend forward from the rear end of the outer surface of each of the upper and lower walls of the female housing, and legs of a gate-shaped lever are installed respectively between the inner side of each plate and the outer surface of the corresponding upper or lower wall of the female housing. A shaft pin is fitted in a shaft hole formed on the plate to support the lever rotatably. The hood of a male housing can penetrate into the space between the outer surfaces of the female housing and the inner sides of the plates.

The housings are fit on each other by initially positioning a follower pin that projects from the outer surface of the male housing into the circular arc-shaped cam groove formed on the lever. Both housings then are moved toward each other by rotating the lever and relying on a cam action between the follower pin and the cam groove.

The front portion of the gate-shaped lever may warp during its molding operation. The front end of a lever that is warped inward can project into the above-described space between the outer surface of the female housing and the inner side of the plate. In this case, the hood of the male housing that penetrates into the space interferes with the front end of the lever when both housings are fitted on each other. Thus, there is a fear that the operation of fitting both housings on each other will be obstructed.

It is conceivable to dispose a plate on the inner side of the lever to correct the inward warp of the lever. In this case, a space for receiving the penetration of the male housing is secured between the plate and the outer surface of the female housing, and a groove for receiving the penetration of the follower pin is formed on the plate.

Rotation of the lever to fit both housings on each other, imposes a force on the lever in a direction in which the lever is opened around the rotational axis. Thus, the lever may deform in the open direction and may slip off the female housing. To solve this problem, it is conceivable to form a slip-off prevention wall on the outer side of the lever to receive the force acting on the lever.

Thus, to prevent both the inward warp of the lever and the slip-off thereof, the lever should be sandwiched between the inner and outer walls, and the dimension of the gap (lever accommodation space) between both walls should be almost equal to the thickness of the lever.

However, this construction causes a problem in installing the lever on the female housing. More particularly, it is necessary to fit the shaft pin of the lever into a hole formed on the inner wall or the outer wall. However, the dimension of the gap between the inner and outer walls is almost equal to the thickness of the lever. Thus, to fit both housings on each other while the lever is being inserted into the gap between the inner and outer walls, it is necessary to forcibly flex the outer wall outward, which causes the installing operation to be difficult.

SUMMARY OF THE INVENTION

The present invention has been made in view of the above-described situation. Accordingly, it is an object of the present invention to perform a lever-installing operation easily.

The invention is directed to a lever-type connector having a first connector housing and a second connector housing. The second connector housing is fitted on an inner side of an outer wall of the first connector housing. A lever is installed on an outer side of the outer wall of the first connector housing and has a cam surface that can engage a follower in the second connector housing. The follower moves along the cam surface in response to a rotation of the lever. Rotation of the lever in one direction will fit the first connector housing and the second connector housing on each other. Rotation of the lever in the opposite direction will separate the first connector housing and the second connector housing from each other.

An accommodation wall is formed on the outer side of the outer wall of the first connector housing. The accommodation wall forms a lever accommodation space for accommodating the lever. Thus, the lever accommodated in the lever accommodation space is sandwiched between the outer wall and the accommodation wall without forming a gap therebetween. The lever is installed rotatably on an installation member by an installing pin, and the installation member, in turn, can be installed on the first connector housing.

A reinforcing wall may connect the outer wall of the first connector housing and the accommodation wall to each other. The reinforcing wall may be formed at a front end of the first connector housing in a fit-on direction.

According to the invention, the lever is installed on the first connector housing, by first installing the lever on the installation member through the installing pin, and then installing the installation member on the first connector housing. The installation member is installed on the first connector housing, by first inserting the lever into the lever accommodation space, so that the lever is sandwiched between the outer wall and the accommodation wall without forming a gap therebetween.

Let it be supposed that molding causes the front end of the lever to be warped inward in the fit-on direction. In this case, when the lever is inserted into the lever accommodation space, the inward warp of the lever is corrected into a normal configuration because the distance between the outer wall and the accommodation wall is almost equal to the thickness of the lever.

In fitting both connector housings on each other, the lever is rotated in the state in which the follower of the second connector housing engages the cam surface of the lever. During the rotation of the lever, a force acts on the lever in a direction that would cause the lever to be opened outward (open direction). However, the lever is sandwiched between the outer wall and the accommodation wall without forming a gap therebetween. Thus, it is possible to prevent the lever from being opened outward.

Before the lever is inserted into the lever accommodation space, the lever is installed on the installation member through the installing pin. Thus, the lever can be accommodated easily in the lever accommodation space, even though the distance between the outer wall and the accommodation wall is almost equal to the thickness of the lever.

The reinforcing wall increases the strength of the accommodation wall. Further, it is possible to prevent a foreign matter from colliding with the lever at the front side in the fit-on direction. In a connector having many poles, an accommodation wall is necessarily long. Consequently, the accommodation wall is apt to have a low strength. In this respect, the present invention is particularly effective for such a connector.

DETAILED DESCRIPTION OF THE PREFERRED EMBODIMENTS

A lever-type connector in accordance with the invention comprises a male connector 10 and a female connector 20, as shown in FIGS. 1, 2 and 13–19. A lever 70 is installed on the female connector 20 to facilitate efficient fitting of the female connector 20 on the male connector 10, as described herein. In the description below, sides of the male connector 10 and the female connector 20 that engage one another are referred to as the front or forward sides.

Figure 1:
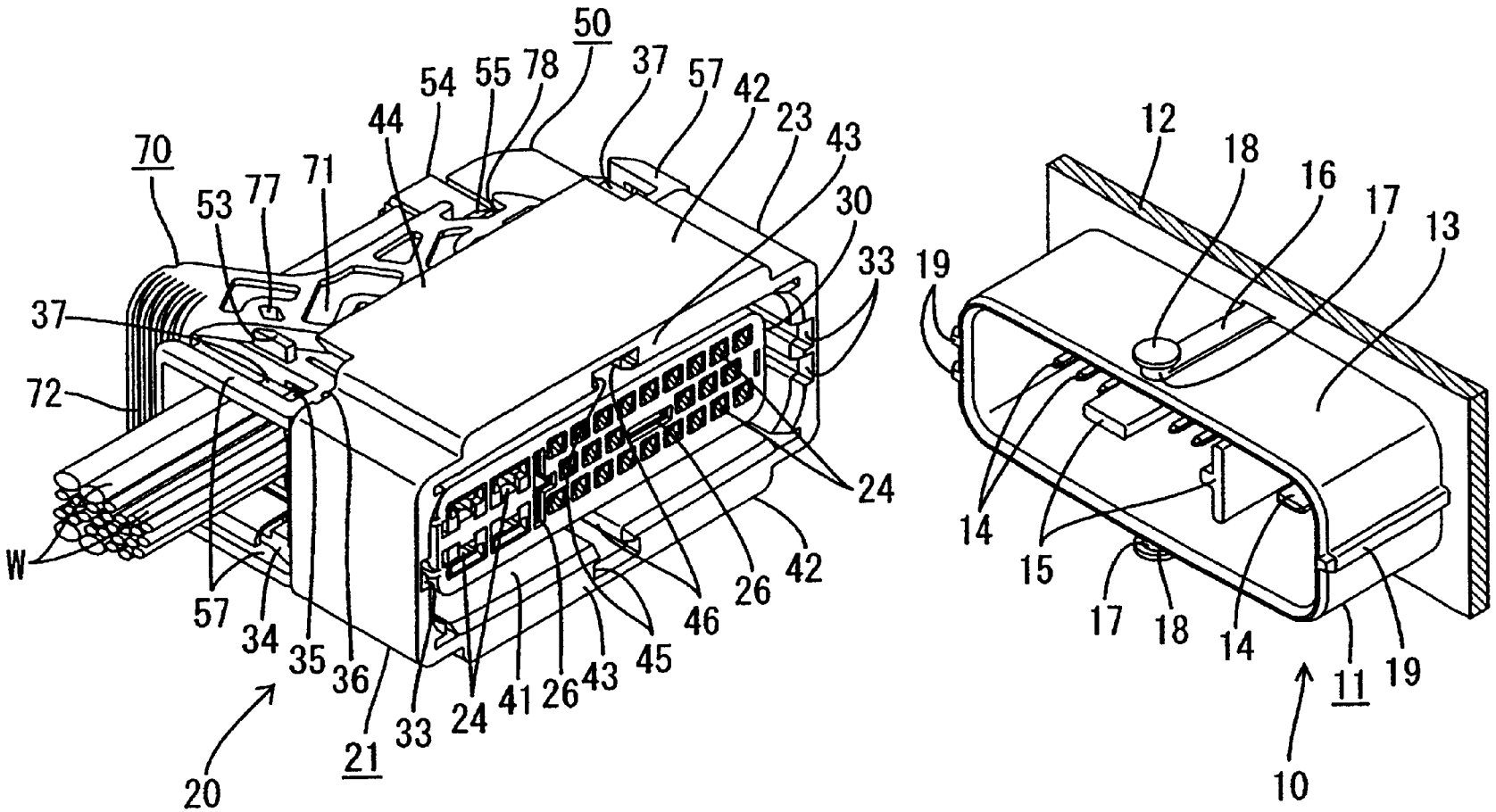
FIG. 1 is a perspective view showing male and female connectors according to an embodiment of the present invention.
Figure 2:
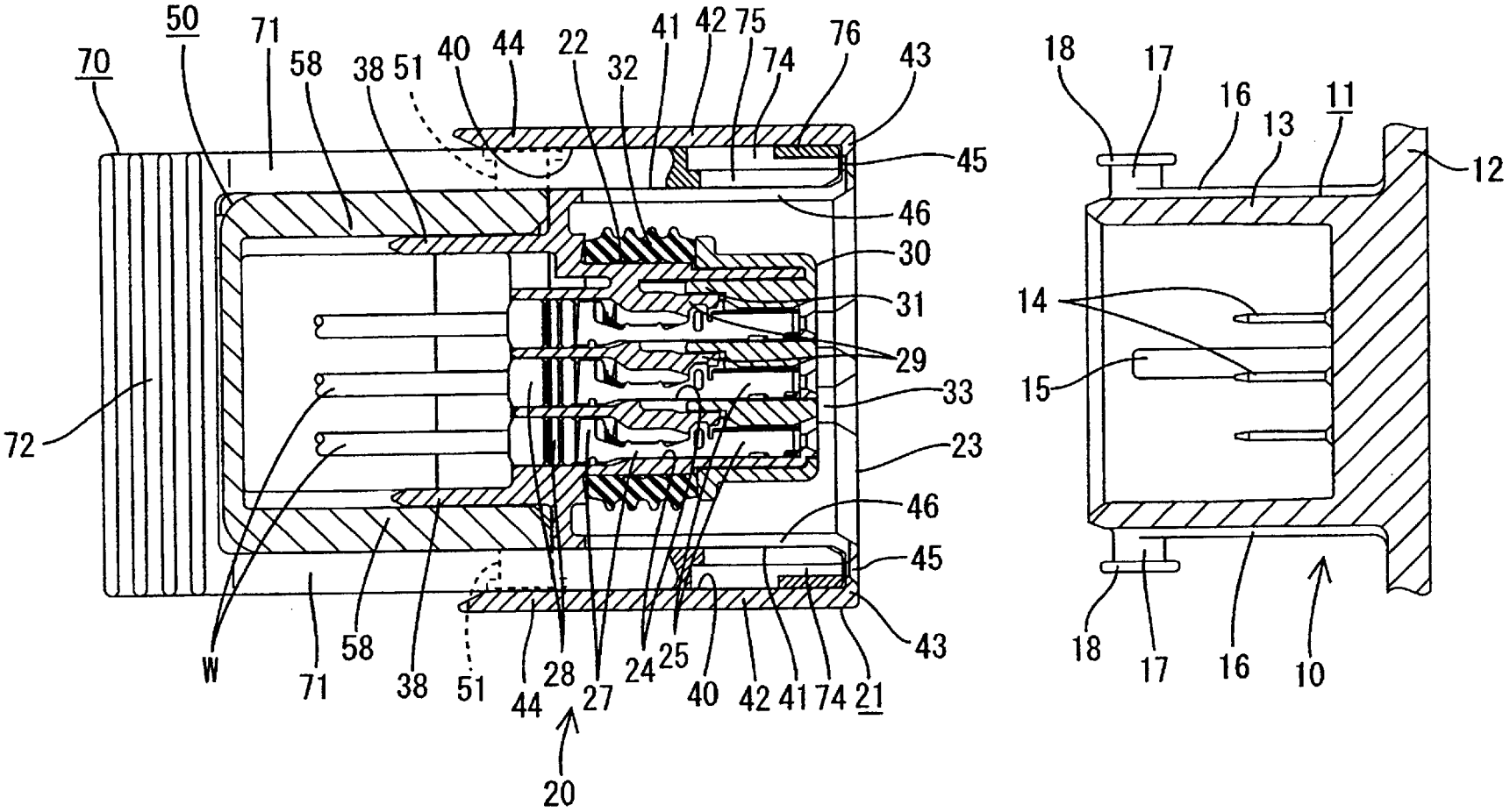
FIG. 2 is a sectional view showing both connectors of FIG. 1.
Figure 3:
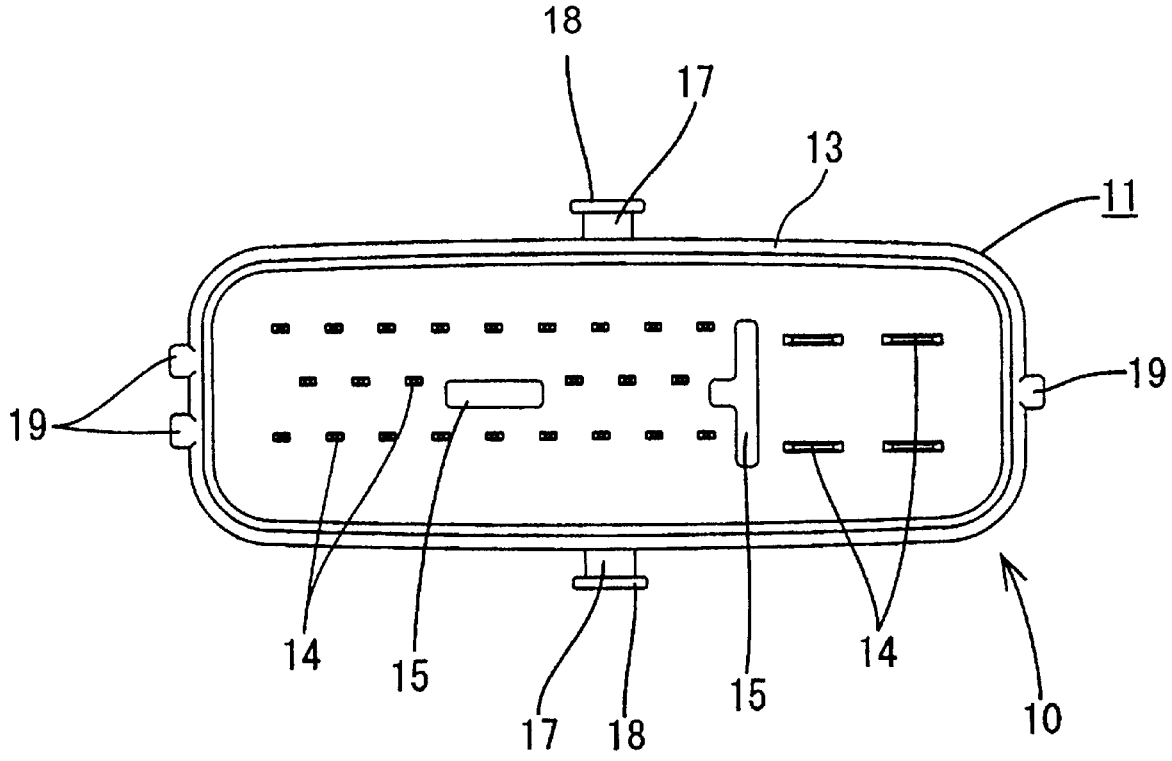
FIG. 3 is a front view showing a male connector.

As shown most clearly in FIGS. 1 and 2, the male connector 10 has a male housing 11 that projects forward from a wall 12 of an electric appliance, and a cylindrical hood 13 projects forward on the male housing 11. As shown in FIGS. 2 and 3, tab-shaped larger and smaller male terminal fittings 14 project forward from the rear end surface of the male housing 11. More specifically, two larger male terminal fittings 14 are provided on each of upper and lower stages located on the right side of FIG. 3, and eight smaller male terminal fittings 14 are provided on each of three stages located on the left side of FIG. 3. Two guide ribs 15 are provided in the male housing 11 such that one is located between the larger and smaller male terminal fittings 14 and that the other having a different shape is located at the center of the smaller male terminal fittings 14. As shown in FIG. 1, a thin guide rail 16 is provided at the longitudinal center of the outer surface of each of the upper and lower walls of the hood 13 of the male housing 11 such that the guide rails 16 extend from the front end of the hood 13 to the rear end thereof. A cylindrical follower pin 17 projects upward from the front end of the upper guide rail 16, and a second cylindrical follower pin 17 projects downward from the front end of the lower guide rail 16. The follower pins 17 are capable of penetrating into cam grooves 74 on the lever 70 of the female connector 20, as described later. A disk-shaped flange 18 is formed on the upper end of each follower pin 17 such that the diameter of the upper flange 18 becomes gradually larger toward its upper end, whereas the diameter of the lower flange 18 becomes gradually larger toward its lower end. Referring to FIG. 1, one guide projection 19 is formed on the hood part 13 at its right side surface, and two guide projections 19 are formed on the hood part 13 at its left side surface. Thus, the male housing 11 is not symmetrical with respect to the center in its longitudinal direction.

Figure 4:
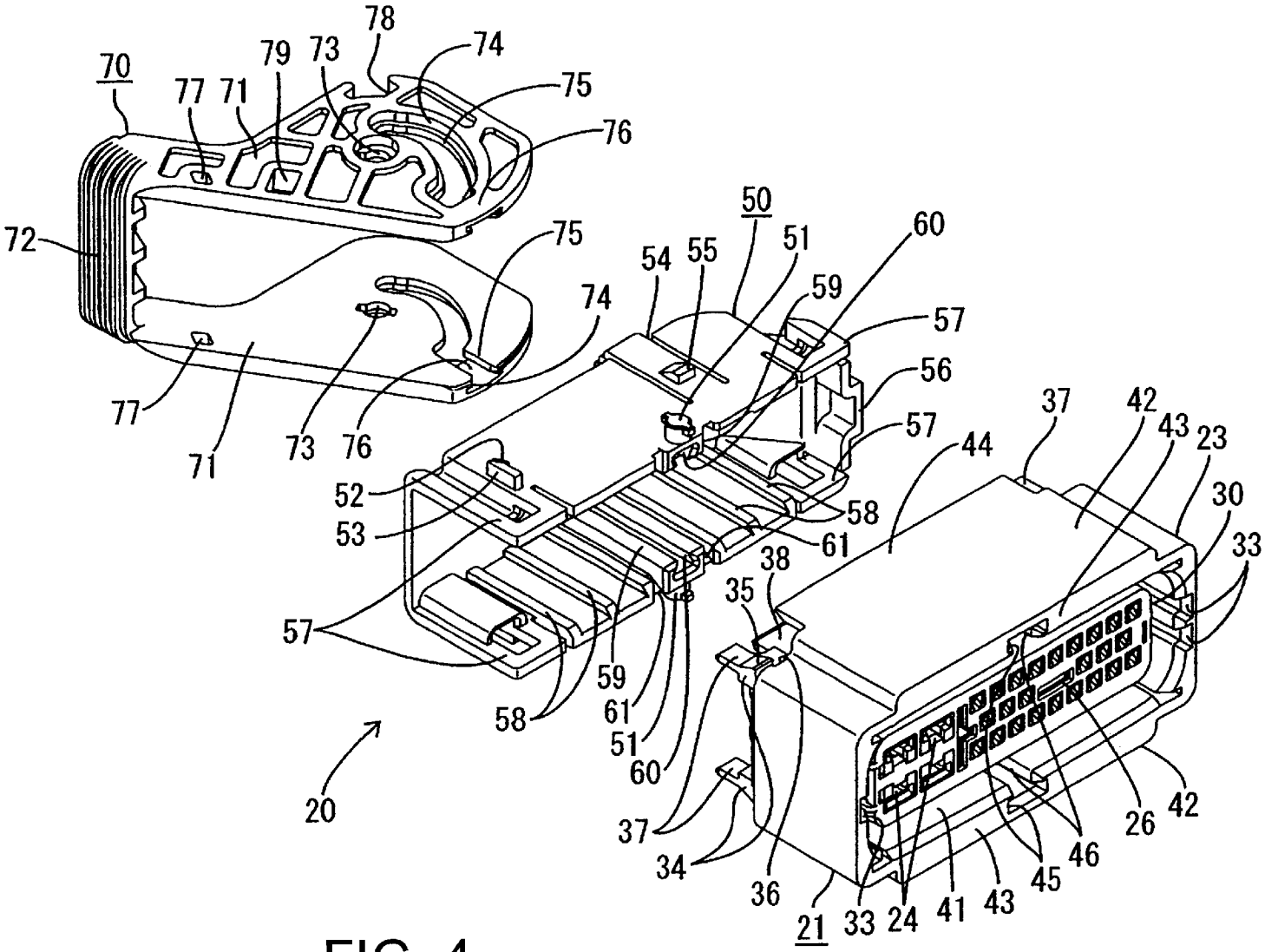
FIG. 4 is a perspective view showing the female housing, a cover, and lever.

As shown in FIG. 4, the female connector 20 has a female housing 21, a cover 50 to be installed on the rear side of female housing 21, and the lever 70 to be installed on the cover 50.

The female housing 21 has a terminal accommodation portion 22, which, as shown in FIG. 2, accommodates female terminal fittings 25. The female housing 21 also has a cylindrical female-side hood 23 that surrounds the terminal accommodation portion 22. The hood 13 of the male housing 11 is capable of penetrating into the space between the terminal accommodation portion 22 and the female-side hood 23.

Figure 5:
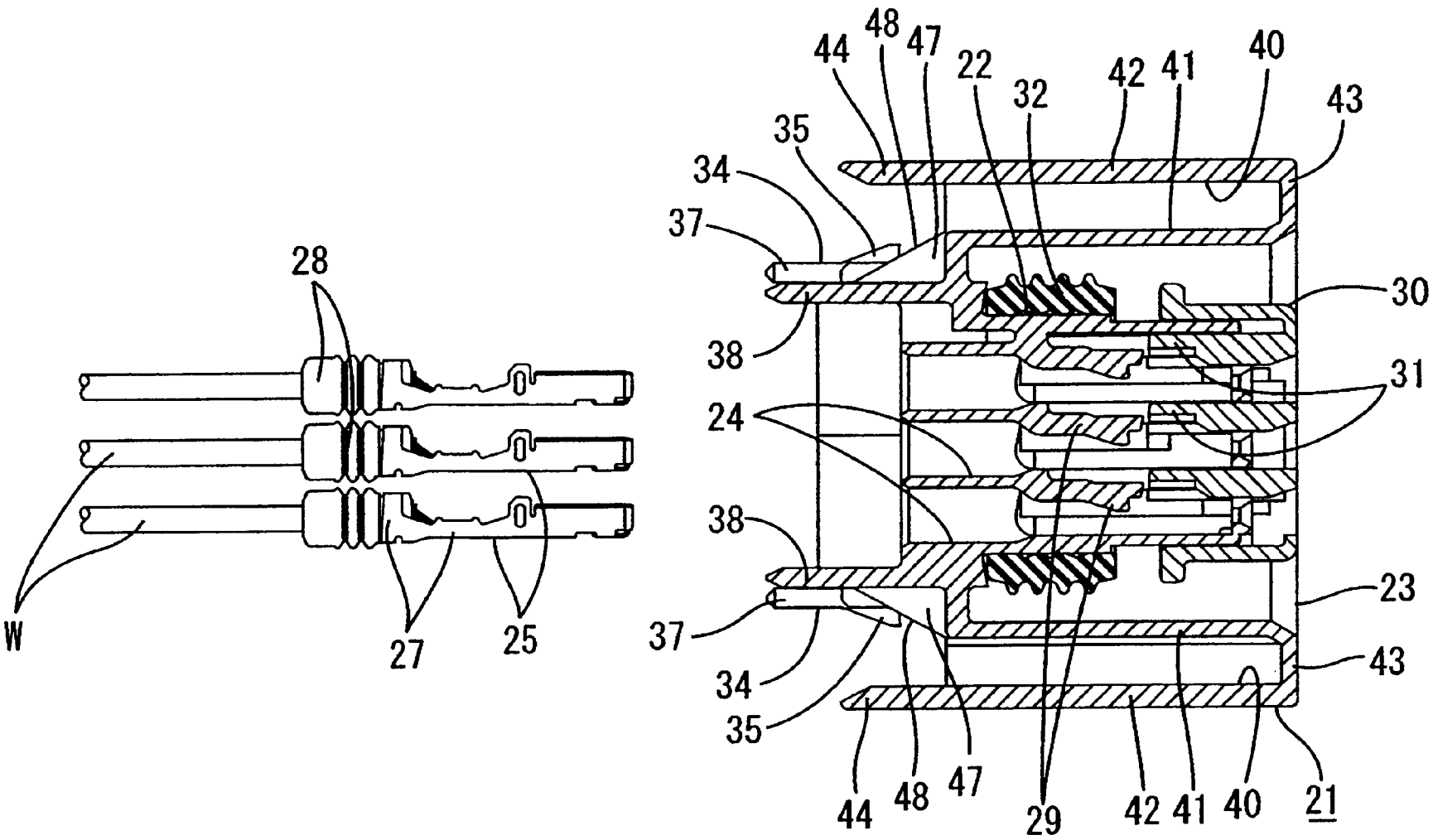
FIG. 5 is a sectional view showing the female housing and a female terminal fitting.

As shown in FIG. 5, the female terminal fittings 25 are connected to the ends of electric wires W and can be inserted into the rear sides of cavities 24 in the terminal accommodation portion 22 at positions corresponding to the male terminal fittings 14 of the male connector 10. More specifically, two larger cavities 24 are provided on each of upper and lower stages located on the left side of FIG. 4 for larger female terminal fittings 25, and smaller cavities 24 are provided on three stages located on the right side of FIG. 4 for smaller female terminal fittings 25. Guide holes 26 are formed at two positions of the front end surface of the terminal accommodation portion 22 for receiving the guide ribs 15 of the male connector 10.

The female terminal fitting 25 is box-shaped at its front part and has a barrel portion 27 at its rear part, as shown in FIG. 5. The barrel portion 27 is crimped to the electric wire W and a rubber plug 28 is mounted at the terminal thereof. The rubber plug 28 is in close contact with inner surface of the rear portion of the cavity 24 to waterproof the inside of the cavity 24. A flexible resin lance 29 is accommodated in the smaller cavity 24 at its lower side and is locked to the rear end of the front portion of the female terminal fitting 25. A forwardly open flexible space S is formed below the lance 29 and allows an elastic deformation of the lance 29. The lances 29 in the larger cavities 24 face in opposite directions, and the flexible space S for the upper and lower larger cavities 24 is between the oppositely facing lances 29.

Figure 6:
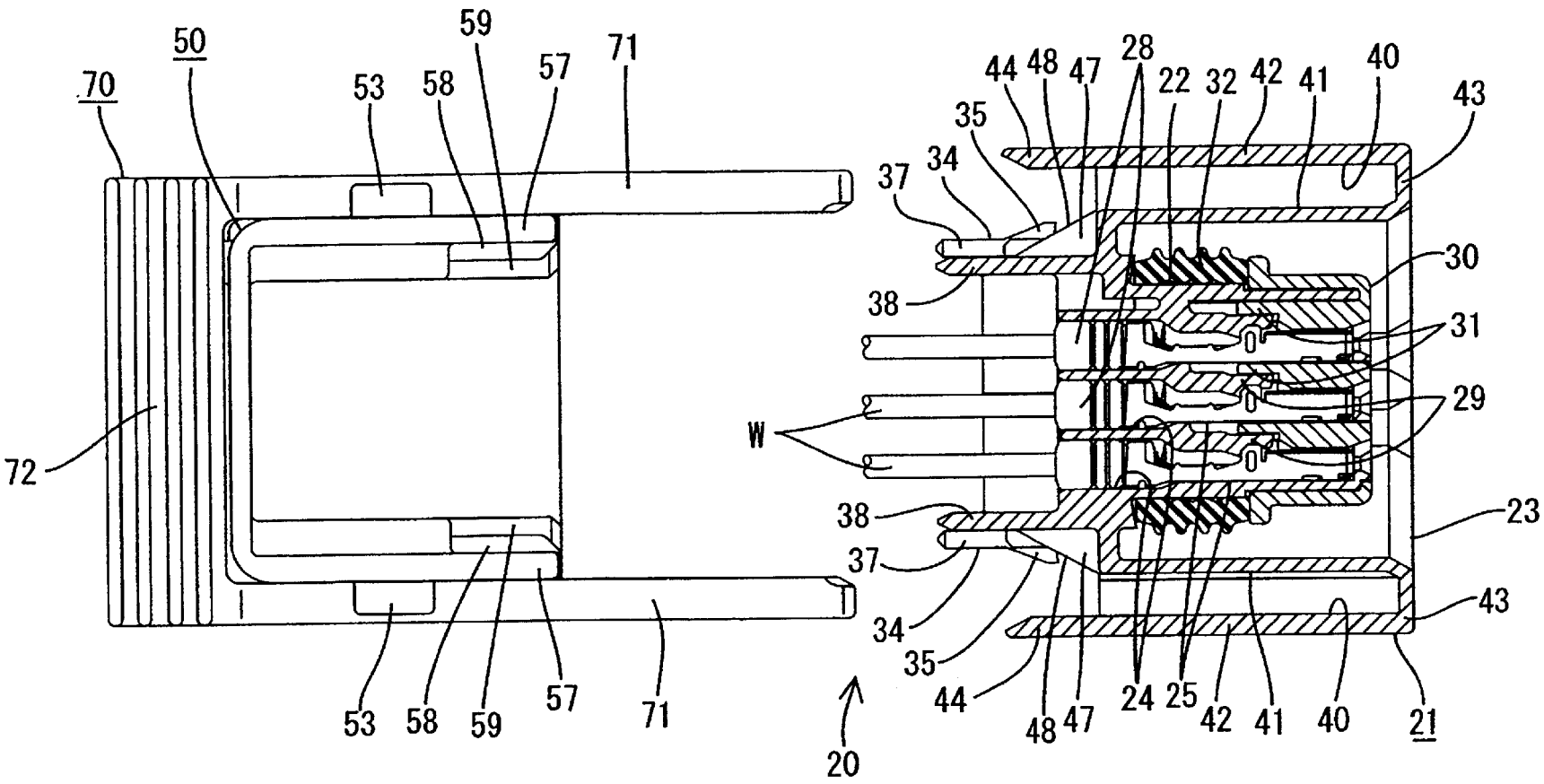
FIG. 6 is a partly cutout side view showing the female housing accommodating the female terminal fitting and the lever-installed cover.

A front retainer 30 can be installed on the peripheral surface of the front side of the terminal accommodation portion 22 and has a flexure prevention portion 31 that can enter each flexible space S. The front retainer 30 is at a temporary locking position before the female terminal fittings 25 are inserted into the cavities 24. In this temporary locking position, the flexure prevention portion 31 is disposed outside the flexure space S, and flexible deformation of the lances 29 is permitted. As shown in FIG. 6, the front retainer 30 is moved to the main locking position after the female terminal fittings 25 are inserted into the cavities 24. Thus, the flexure prevention portion 31 enters the flexure space S, and the flexure of the lances 29 is prevented. The front retainer 30 is held at the temporary locking position and the main locking position by an unshown holding construction.

A seal ring 32 can be installed on the front retainer 30 installed on the terminal accommodation portion 22, such that the seal ring 32 is in close contact with the peripheral surface of the rear side of the front retainer 30. The inner peripheral surface of the hood 13 can be fitted on the outer side of the terminal accommodation portion 22 and in close contact with the peripheral surface of the seal ring 32. Four lips project on each of the inner peripheral surface and outer peripheral surface of the seal ring 32.

The female-side hood 23 projects outward and forward in a stepwise manner from the peripheral surface of the rear side of the terminal accommodation portion 22. An installation construction for installing the cover 50 (described later) on the female housing 21 is provided on the rear end of the female-side hood 23. As shown in FIG. 4, the upper and lower walls of the female-side hood 23 are formed stepwise and open rearward like a bag. The female-side hood 23 has a lever accommodation space 40 for accommodating the lever 70. Guide grooves 33 extend rearward a predetermined length from the front end of the inner surface of the female-side hood 23 at positions corresponding to the positions of the respective guide projections 19 of the male housing 11.

Figure 7:
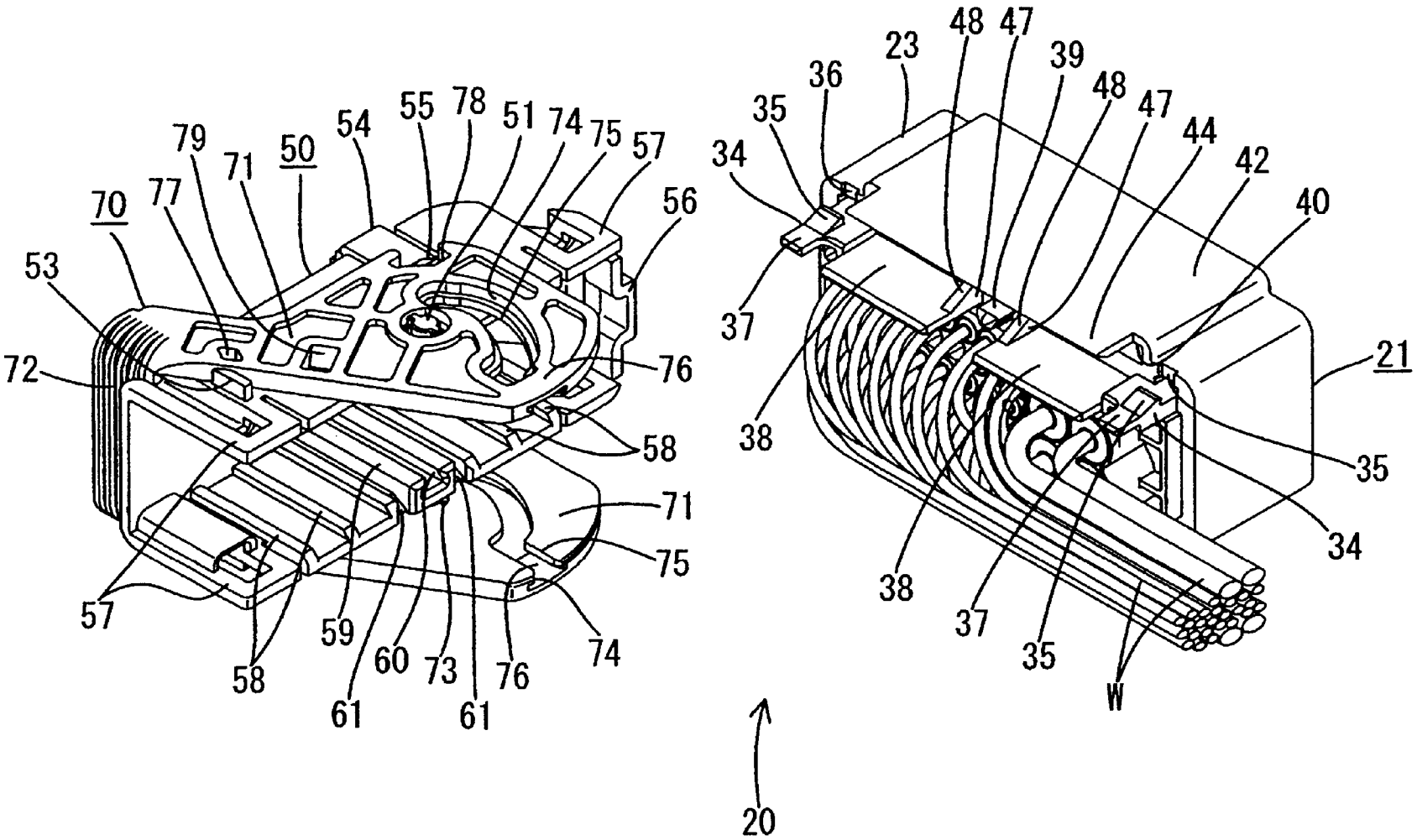
FIG. 7 is an exploded perspective view showing the female connector.

As shown in FIG. 4, the cover 50 is box-shaped, and has an open front side and an open left side. The cover 50 is installed on the female housing 21, with the open front side of the cover 50 covering the rear side of the female housing 21. As shown in FIG. 7, the electric wires W that are to be extended out from the cavities 24 of the female housing 21 are bundled by bending the electric wires W at about 90° to the right. The wires W then are taken out from the open side surface of the cover 50 installed on the rear side of the female housing 21. The side surface of the cover 50 on the right side in FIG. 4 is formed obliquely to guide the electric wires W to the left side in FIG. 4. As shown in FIG. 4, cylindrical shafts 51 project vertically on the outer surface of the upper and lower walls of the cover 50, and enable rotational mounting of the lever 70, as explained below. Each shaft 51 is disposed at approximately the center in the longitudinal direction of the cover 50 and is positioned at the front end of the cover 50. Two projections project in the front-to-back (widthwise) direction at the upper end of the upper shaft 51, and two projections project in the front-to-back (widthwise) direction at the lower end of the lower shaft 51.

Figure 16:
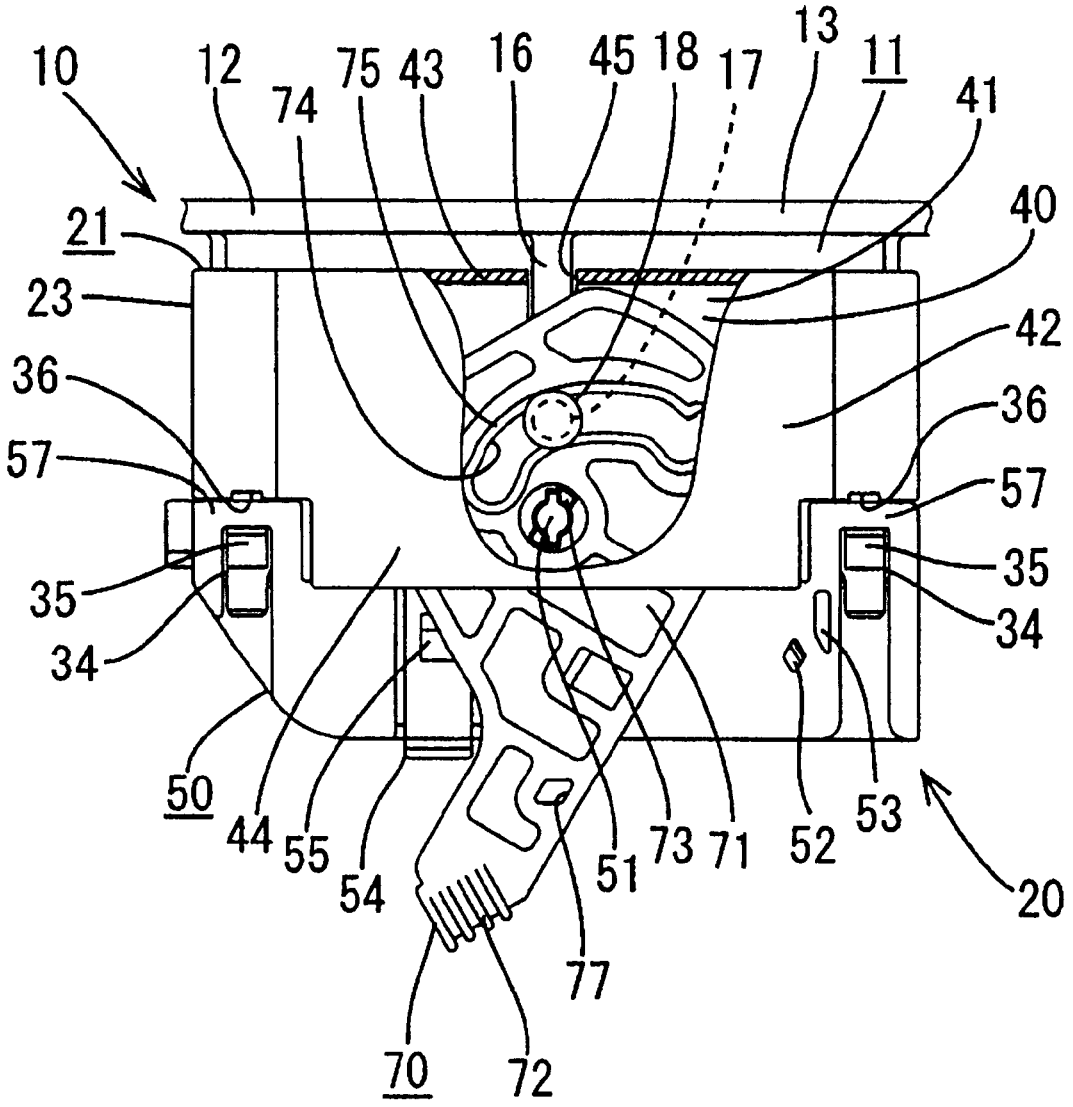
FIG. 16 is partly cutout plan view showing a state in which both connectors are being fitted on each other.

The lever 70 has a pair of legs 71, and an operation portion 72 connects ends of the legs 71 to each other, as shown in FIG. 4. Thus the lever 70 is gate-shaped. The lever 70 is installed on the cover 50, with both legs 71 sandwiching the cover vertically. A shaft hole 73 penetrates through each leg 71, and the shafts 51 of the cover 50 are fitted through the shaft holes of the respective legs 71. Thus, the lever 70 is rotatable on the shafts 51. The configurations of the shaft holes 73 are almost the same as the configurations of the shafts 51. A circular hole is formed over each shaft hole 73 to prevent the projections of the shafts 51 from interfering with the portion over the shaft hole 73 when the lever 70 rotates. As shown in FIG. 7, the shafts 51 and the outer surfaces of the lever 70 are almost flush with each other when the lever 70 is installed on the cover 50. As shown in FIG. 4, a circular arc-shaped cam groove 74 is formed on each of the legs 71. The cam grooves 74 are dimensioned and disposed to receive the follower pins 17 of the male housing 11. A receiving portion 75 is formed throughout the entire length of the inner side of the cam groove 74 and is dimensioned to receive the flange 18 of the follower pin 17. An entrance to the cam groove 74 is continuous with a bridging portion 76 that confronts the receiving portion 75. The lever 70 can be rotated after the follower pin 17 has entered the entrance of the cam groove 74. This rotation causes the follower pin 17 to move along the cam groove 74 and an operation of fitting the male connector 10 and the female connector 20 on each other progresses, as shown in FIG. 16.

The lever 70 is installed on the cover 50 by fitting the shafts 51 in the shaft holes 73 while both legs 71 are opened from the state shown in FIG. 4. Then, as shown in FIG. 7, the lever 70 is rotated a predetermined angle to place the lever 70 at an initial position at which the entrance of the cam groove 74 faces the front. At the initial position, a pair of first holding projections 52 on the outer surface of the upper and lower walls of the cover 50 lock to a pair of first holding holes 77 on the upper and lower legs 71, respectively. Thus, the lever 70 is unrotatably held unless a sufficient force is applied to the lever. The side surface, of each leg 71, on the left side in FIG. 4 is brought into contact with a stopper projection 53 formed on the side surface of each first holding projection 52, and the side surface of the operation portion 72 is bought into contact with the rear surface of the cover 50. In this manner, the lever 70 can be prevented from dislocating from the initial position.

An elastically deformable cantilevered holding arm 54 projects rearward from the outer surface of the upper wall of the cover 50. A second holding projection 55 is formed on the upper surface of the holding arm 54. The second holding projection 55 can be locked to a cutout 78 formed on the rear end surface of the cam groove 74 of the upper leg 71 of the lever 70. A stepped operation portion is formed at the free end of the holding arm 54. At this stage, the portion of each leg 71 that is forward from the shaft hole 73 and that has the entrance of the cam groove 74 projects forward beyond the front end of the cover 50. At the initial position, both legs 71 can be prevented from slipping off from the cover 50 by placing the shafts 51 and the shaft holes 73 at unmatching positions.

Figure 18:
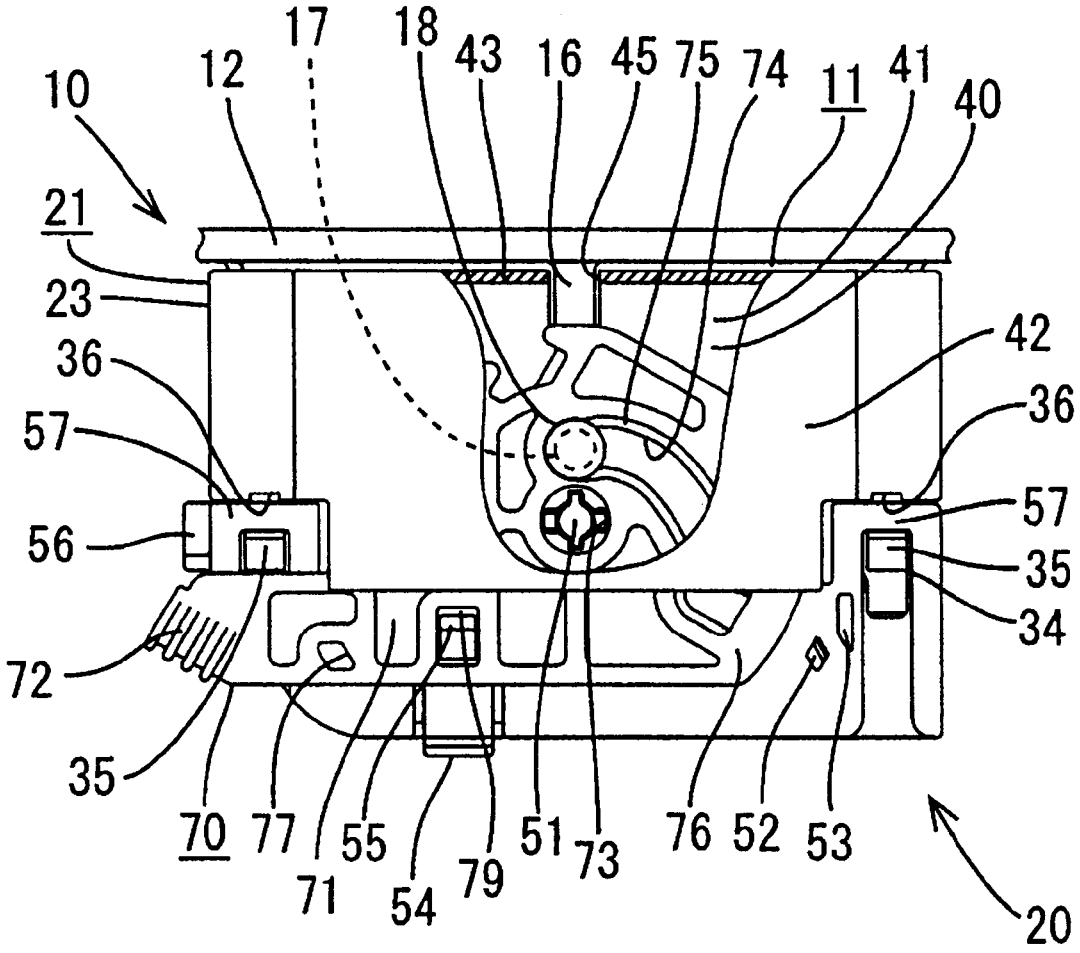
FIG. 18 is partly cutout plan view showing a state in which both connectors have been normally fitted on each other.

The lever 70 is rotated from the initial position to a completion position shown in FIG. 18. Referring to FIG. 4, at the completion position, the second holding projection 55 of the holding arm 54 is locked to a second holding hole 79 formed on the upper leg 71 to hold the lever 70 unrotatably in a reverse direction. At this time, the termination of each cam groove 74 is disposed immediately before the respective shaft 51, the shafts 51 are orthogonal to the shaft holes 73, the lever 70 does not project rearward beyond the rear end of the cover 50, and the side surface of the operation portion 72 is in contact with a stopper 56 on the side surface of the cover 50, as shown on the right side in FIG. 4.

Figure 8:
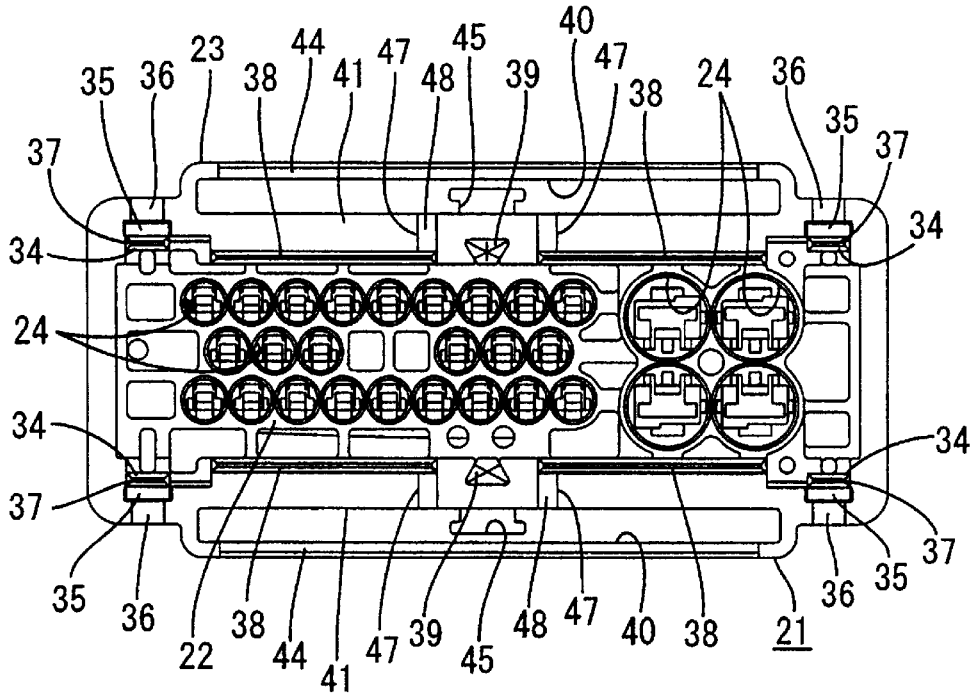
FIG. 8 is a rear view showing the female housing.
Figure 9:
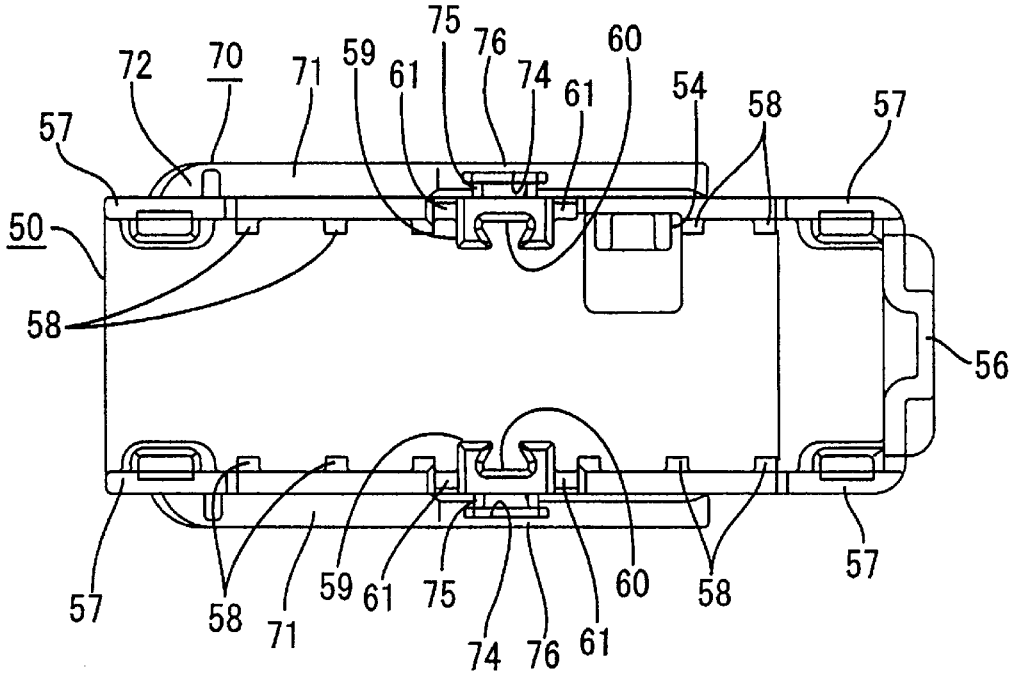
FIG. 9 is a front view showing the lever-installed cover.
Figure 10:
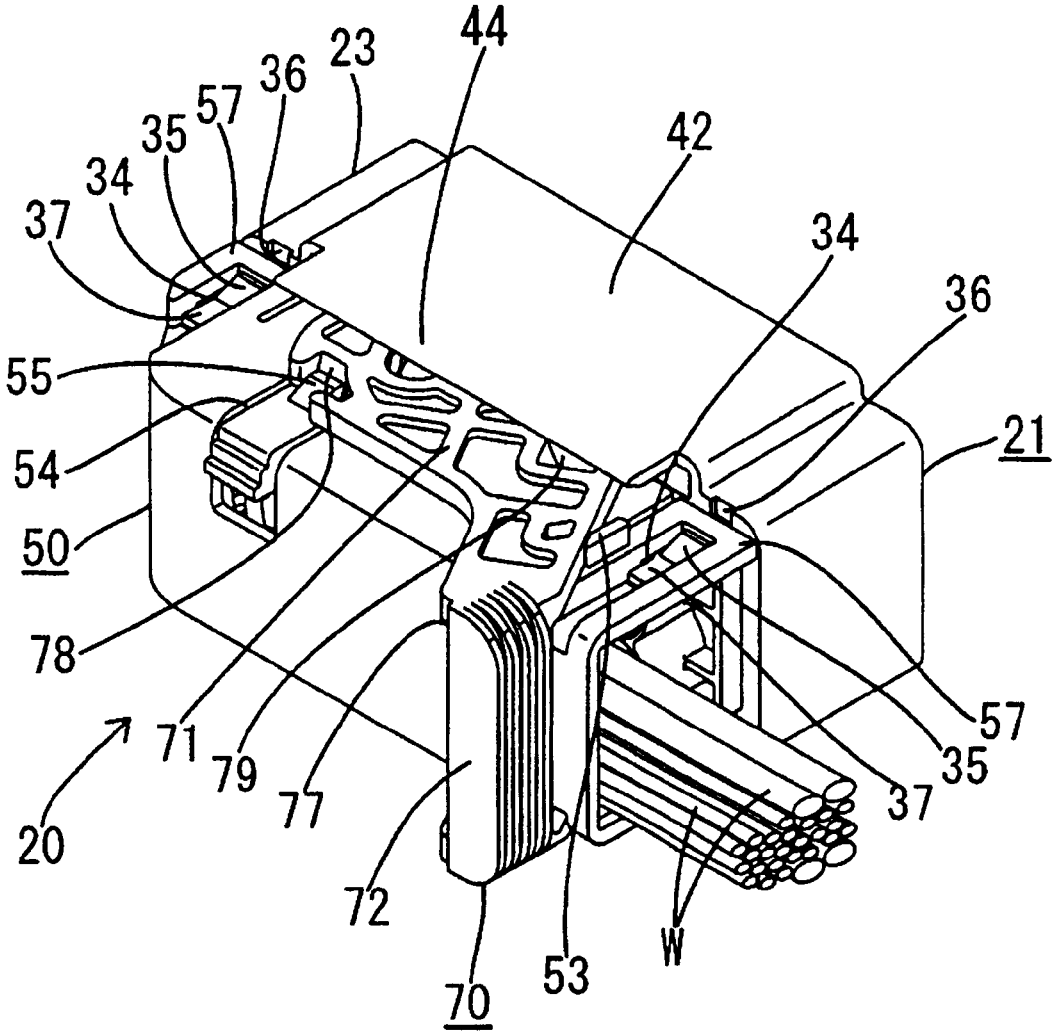
FIG. 10 is a perspective view showing the female connector.

Cover-installing portions 34 project rearward from the four corners of the rear end surface of the female-side hood 23 of the female housing 21, as shown in FIGS. 7 and 8. A locking projection 35 is formed on the outer surface of each cover-installing portion 34. As shown in FIGS. 7 and 9, cantilevered locking pieces 57 project forwardly at both ends of the outer surface of upper and lower walls of the cover 50. The locking pieces 57 are locked to the locking projections 35 of the cover-installing portions 34, as shown in FIG. 10, to keep the cover 50 installed on the female housing 21. In the installed state, the front end surface of the cover 50 is in contact with the rear end surface of the female-side hood 23. A tapered surface is formed on the rear of each locking projection 35 to allow the locking piece 57 to ride over the locking projection 35 easily. Jig insertion grooves 36 are formed on the rear end surface of the female-side hood 23 at a positions that confront the front surface of the locking projection 35. The jig insertion grooves 36 are configured to receive an unlocking jig.

As shown in FIGS. 7 and 8, a guide projection 37 projects rearward from the locking projection 35 on each cover-installing portion 34. Upper and lower flat guide plates 38 are formed on the rear end surface of the female-side hood 23 at the center thereof in its longitudinal direction and are spaced at a predetermined interval. As shown in FIG. 7, the rear end of the guide projection 37 and that of the guide plate 38 are flush with each other in the longitudinal direction of the female housing 21. Thus, in installing the cover 50 on the female housing 21, each guide projection 37 slides on the locking piece 57, and each guide plate 38 slides on each of a plurality of convexities 58 formed on the inner surface of the upper and lower walls of the cover 50. Accordingly, the cover-installing operation can be facilitated. The inner surface of the guide projection 37 contacts the outer surface of an inwardly concave portion formed on the rear side of the locking piece 57 of the cover 50.

As shown in FIGS. 7 and 9, a positioning convexity 59 is formed at the center of the inner surface of the upper and lower walls of the cover 50. The positioning convexity 59 is located inward from the convexities 58 located at the right and left thereof, as shown in FIGS. 8 and 9. Thus, the positioning convexity 59 is fitted between the right and left guide plates 38 of the female housing 21. The positioning convexity 59 serves as the means for positioning the cover 50 in its longitudinal direction during installation of the cover 50 on the female housing 21.

As shown in FIGS. 7 and 9, an engaging groove 60 is formed on each positioning convexity 59 throughout its entire length. The engaging groove 60 is open forward and inward. The width of the engaging groove 60 becomes smaller toward its inward end. The engaging groove 60 is coincident with the shaft 51 in the widthwise direction of the cover 50. As shown in FIGS. 7 and 8, an engaging projection 39 projects rearward between the right and left guide plates 38 on the upper and lower rear end surfaces of the female-side hood 23, and can enter the engaging groove 60 of the cover 50. The engaging projection 39 has a configuration matching that of the periphery of the engaging groove 60. When the engaging projection 39 has entered the engaging groove 60, the side surface of the engaging projection 39 engages the periphery of the engaging groove 60. The engaging projection 39 is continuous with the outer surface of the rear end of the terminal accommodation portion 22 projecting rearward from the female-side hood 23.

Because the cover-installing construction is vertically symmetrical, the cover 50 can be installed on the female housing 21 when the cover 50 is turned upside down. Depending on a place on which the lever-type connector is installed, it is possible to change the direction in which the electric wire W is wired and the rotational direction of the lever 70.

Figure 13:
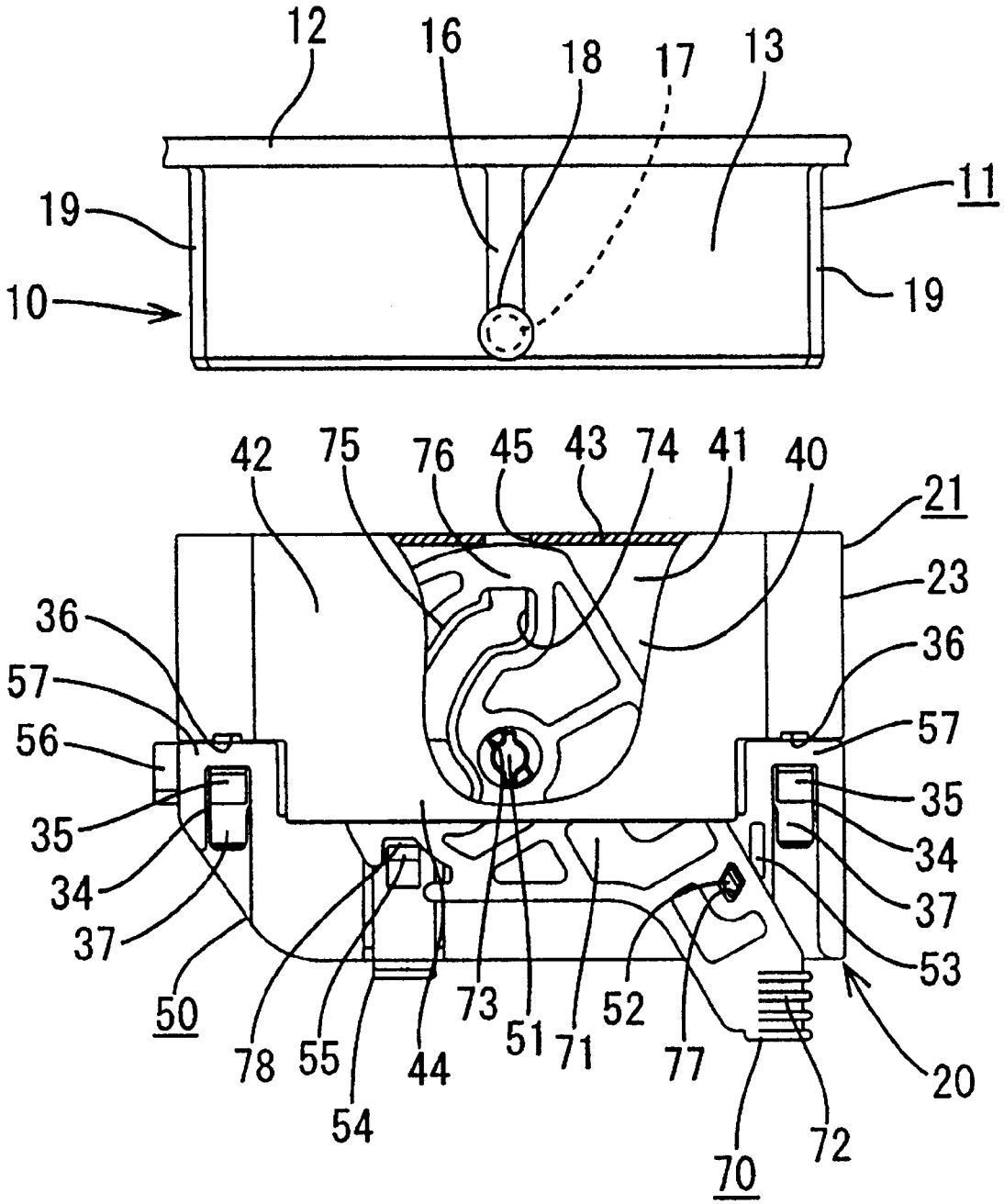
FIG. 13 is partly cutout plan view showing a state in which both connectors are fitted on each other.

As shown in FIGS. 6 and 7, the lever 70 installed on the cover 50 at the initial position is inserted into a lever accommodation space 40, as the operation of installing the cover 50 on the female housing 21 proceeds. More specifically, the lever accommodation space 40 is formed between a wall 41 and an accommodation wall 42 forming the longitudinal portion of the female-side hood 23. The lever accommodation space 40 is open rearward, and the front end of the wall 41 and that of the accommodation wall 42 are continuous with each other through a reinforcing wall 43. The interval between the wall 41 and the accommodation wall 42 is almost equal to the thickness of the lever 70. Thus, as shown in FIGS. 2 and 13, the leg 71 of the lever 70 in the lever accommodation space 40 is held straight. Both ends of the accommodation wall 42 in its longitudinal direction are continuous with the wall 41, and the front end of the accommodation wall 42 is continuous with the wall 41 through the reinforcing wall 43. Thus, the accommodation wall 42 has a high strength. When the lever 70 is accommodated in the lever accommodation space 40, a portion of the leg 71 projecting forward from the front end of the cover 50 is covered with the accommodation wall 42. At this time, the outer surface of the cover 50 and that of the wall 41 form a continuous plane.

An extended wall 44 projects rearward from the rear end of the accommodation wall 42. The extended wall 44 covers a shaft construction portion that consists of the shaft 51 of the cover 50 and the shaft hole 73 of the lever 70. That is, the accommodation wall 42 and the extended wall 44 cover the entire lever 70 placed at the initial position from the shaft construction portion to the front end of the lever 70, including the entrance of the cam groove 74. A tapered surface for guiding the lever 70 into the lever accommodation space 40 is formed on the inner surface of the rear end of the extended wall 44.

As shown in FIGS. 1 and 8, the reinforcing wall 43 has an introduction opening 45 that permits penetration of the follower pin 17 of the male housing 11. At the initial position, the front end of the lever 70 is located immediately rearward from the reinforcing wall 43, and the entrance of the cam groove 74 matches the introduction opening 45. As shown in FIGS. 1 and 2, the wall 41 has a guide groove 46 that communicates with the introduction opening 45. A portion of the guide rail 16 located at the root of the follower pin 17 penetrates into the guide groove 46.

As shown in FIGS. 6 and 7, a triangular guide 47 is formed on the inward edge of each guide plate 38 and extends in the front-to-back (widthwise) direction of the female housing 21. The guide 47 is formed by connecting the base of the guide plate 38 and the rear end surface of the female-side hood 23 to each other, thus supporting the guide plate 38 to reinforce the strength thereof. An inclined plane 48 of the guide 47 is continuous with the outer surface of the guide plate 38 and the outer surface of the wall 41. Insertion of the lever 70 into the lever accommodation space 40, includes bringing the front end of the lever 70 into contact with the inclined plane 48 to guide the penetration of the lever 70. The engaging projection 39 sandwiched between the right and left guide portions 47 is a little shorter than the guide portion 47. A cutout 61 for escaping the guide portion 47 is formed at the front end of the cover 50, with the cutout 61 located at both sides of the positioning convexity 59.

The operation of the lever-type connector of the embodiment having the above-described construction will be described below. After the female connector 20 is assembled from the cover 50 and the lever 70, the male and female connectors are fitted on each other.

As shown in FIG. 7, the female connector 20 is assembled by initially installing the lever 70 on the cover 50 such that the entrance of the cam groove 74 faces the front. Then, as shown in FIG. 5, the seal ring 32 is installed on the terminal accommodation portion 22 of the female housing 21, and the front retainer 30 is installed at the temporary locking position. In this state, the female terminal fittings 25 are inserted into each cavity 24 from the rear of the female housing 21. Then, as shown in FIG. 6, the front retainer 30 is pressed into the main locking position to hold the female terminal fitting 25 in a double locking state. Thereafter, as shown in FIG. 7, the electric wires W taken out from the rear side of the female housing 21 are bundled by bending the electric wires W at about 90° toward the right in FIG. 7. In this state, the cover 50 and the lever 70 are installed on the female housing 21 from the rear. In this installing process, the front end of the lever 70 is inserted into the lever accommodation space 40 before the cover contacts the female housing 21.

Figure 11:
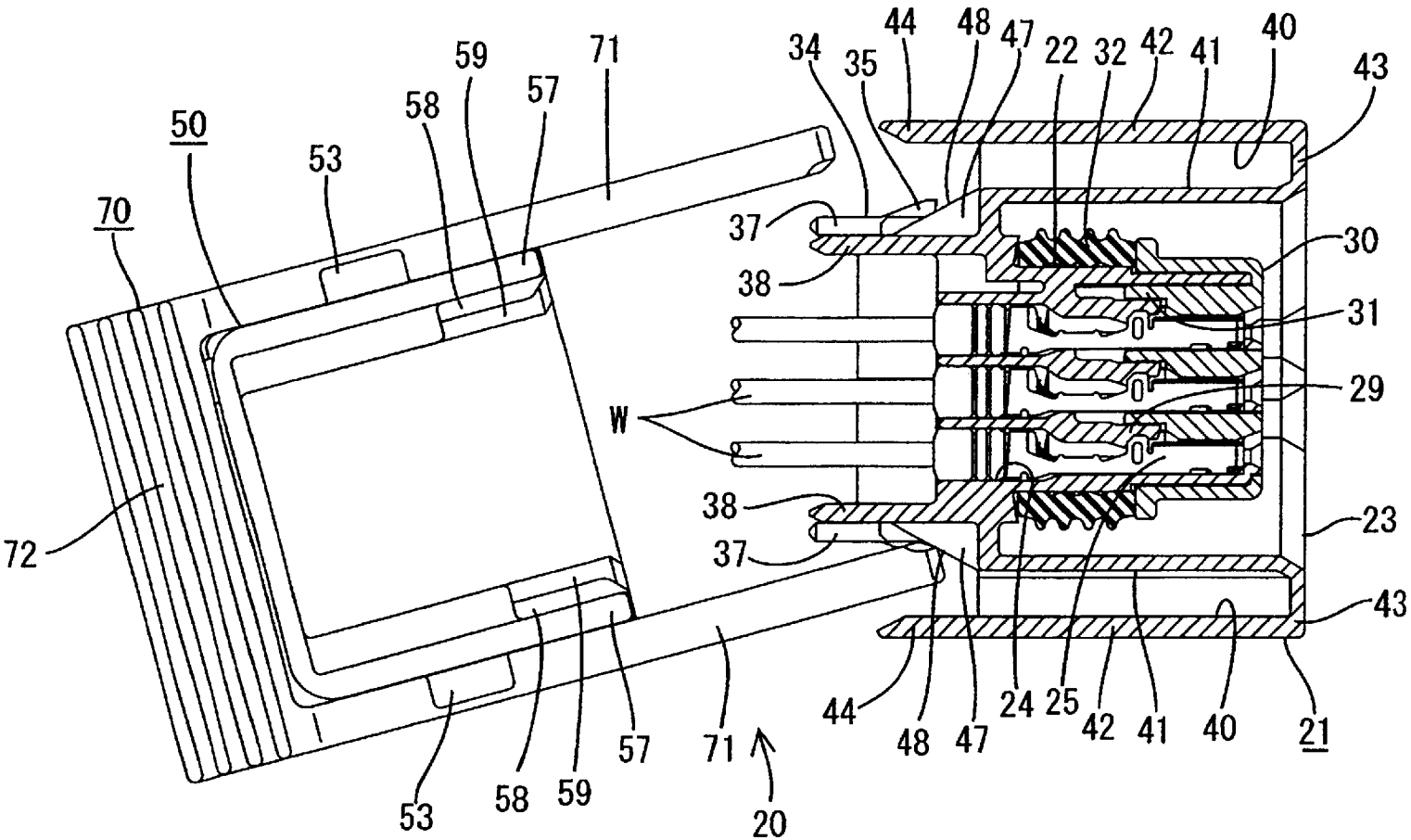
FIG. 11 is partly cutout side view showing a state in which the front end of the lever whose installing posture has inclined is in contact with a guide portion.

When the cover 50 and the lever 70 are installed on the female housing 21 obliquely, as shown in FIG. 11, the front end of the lever 70 contacts the inclined plane 48 of the guide 47. The inclined plane 48 is continuous with the inner surface of the lever accommodation space 40. Thus, owing to the contact between the front end of the lever 70 and the inclined plane 48, the lever 70 is inserted smoothly into the lever accommodation space 40.

Figure 12:
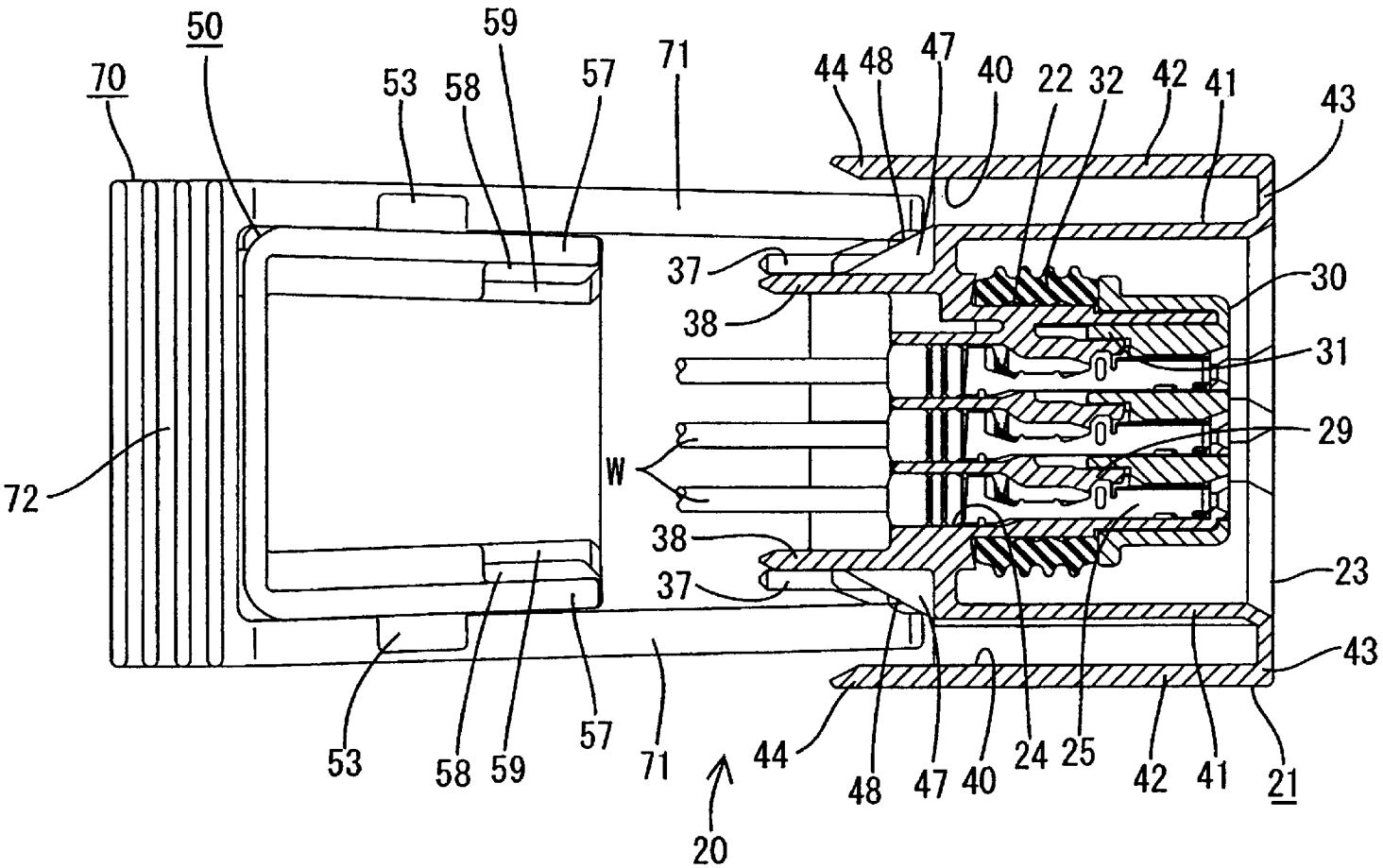
FIG. 12 is partly cutout side view showing a state in which the front end of the lever warped inward is in contact with the guide portion.

As shown in FIG. 12, the molding of the lever 70 may cause the front portion of the leg 71 to warp inward. Let it be supposed that the inwardly warped leg 71 is installed on the female housing 21. In this case, even though the cover 50 and the lever 70 are installed on the female housing 21 in a normal posture, the front end of the lever 70 contacts the guide portion 47. When the lever 70 is moved forward in this state, the front end of the lever 70 slides on the inclined plane 48 and both legs 71 are inserted into the lever accommodation space 40, with both legs 71 open outward. That is, even though the lever 70 is warped, it can be accommodated smoothly in the lever accommodation space 40, with the lever being unwarped, namely, straight.

After the lever 70 is inserted into the lever accommodation space 40, the front end of the cover 50 reaches the position immediately rearward from the guide plate 38 and the guide projection 37. The cover 50 could be dislocated widthwise from the female housing 21 at this time. In this case, the front end surface of the positioning convexity 59 contacts the rear end surface of the guide plate 38. Thus, the installing operation is prevented (see FIGS. 8 and 9.) In this case, the cover 50 is slid widthwise to correct the dislocation of the cover 50, and the positioning convexity 59 is fitted between both guide plates 38. When the positioning convexity 59 is penetrated between the guide plates 38, the engaging projection 39 formed between the guide plates 38 is inserted into the engaging groove 60 formed on the positioning convexity 59. At this time, the convexity 58 of the cover 50 slides on the guide plate 38, and the locking piece 57 of the cover 50 slides on the guide projection 37, to facilitate the cover-installing operation. After the locking piece 57 rides over the locking projection 35, the locking piece 57 is locked to the locking projection 35. Consequently, as shown in FIG. 10, the cover 50 is secured to the female housing 21. At this time, the front end surface of the cover 50 is in contact with the stepped portion of the rear end surface of the female-side hood part 23. Additionally, as shown in FIG. 13, the front end of the lever 70 is disposed immediately rearward from the reinforcing wall 43, and the entrance of the cam groove 74 is placed at a position matching the introduction opening 45 of the reinforcing wall 43.

As shown in FIG. 2, the leg 71 is sandwiched between the wall 41 and the accommodation wall 42 without forming a gap therebetween. Thus, if the leg 71 of the lever 70 is warped inward as shown in FIG. 12, the lever 70 can be accommodated in the lever accommodation space 40, with the leg 71 being kept unwarped or straight.

Figure 14:
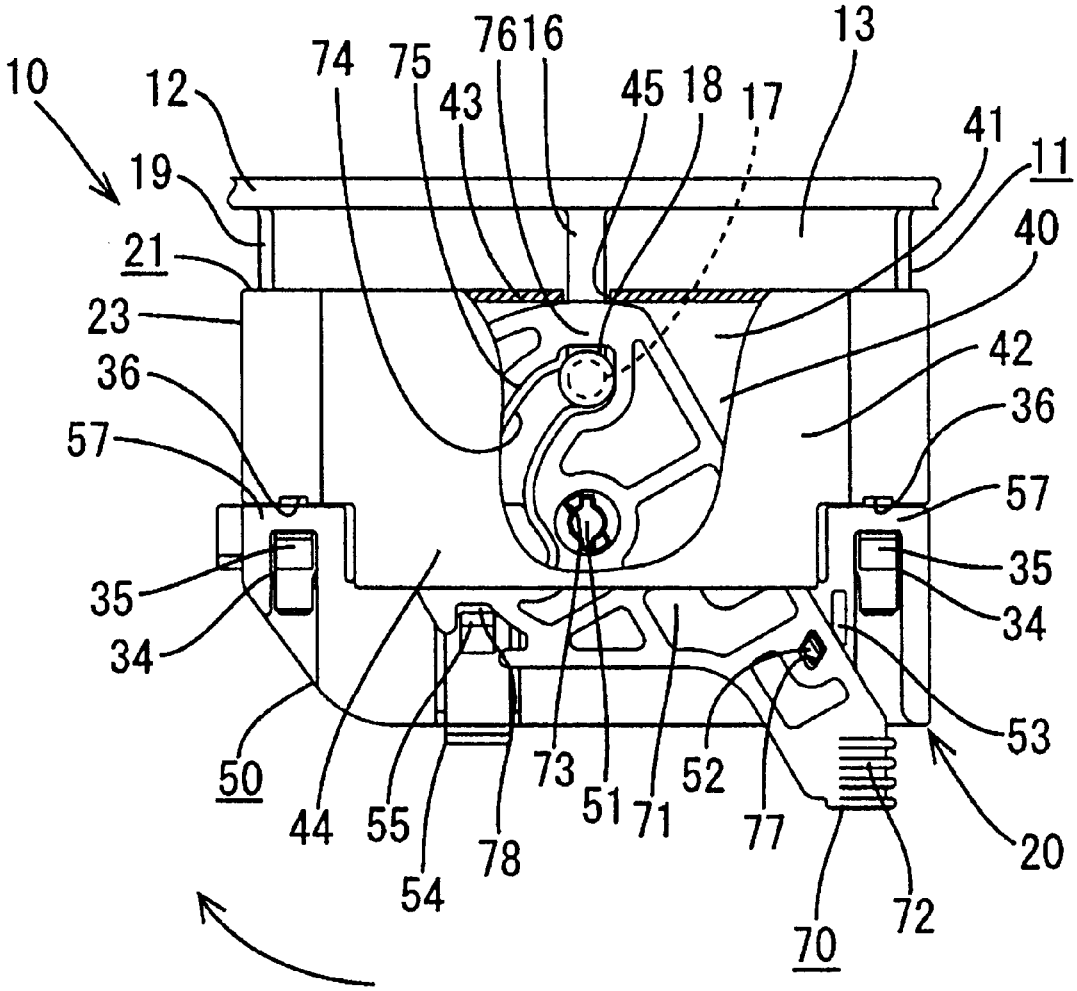
FIG. 14 is partly cutout plan view showing an initial state in fitting both connectors on each other.
Figure 15:
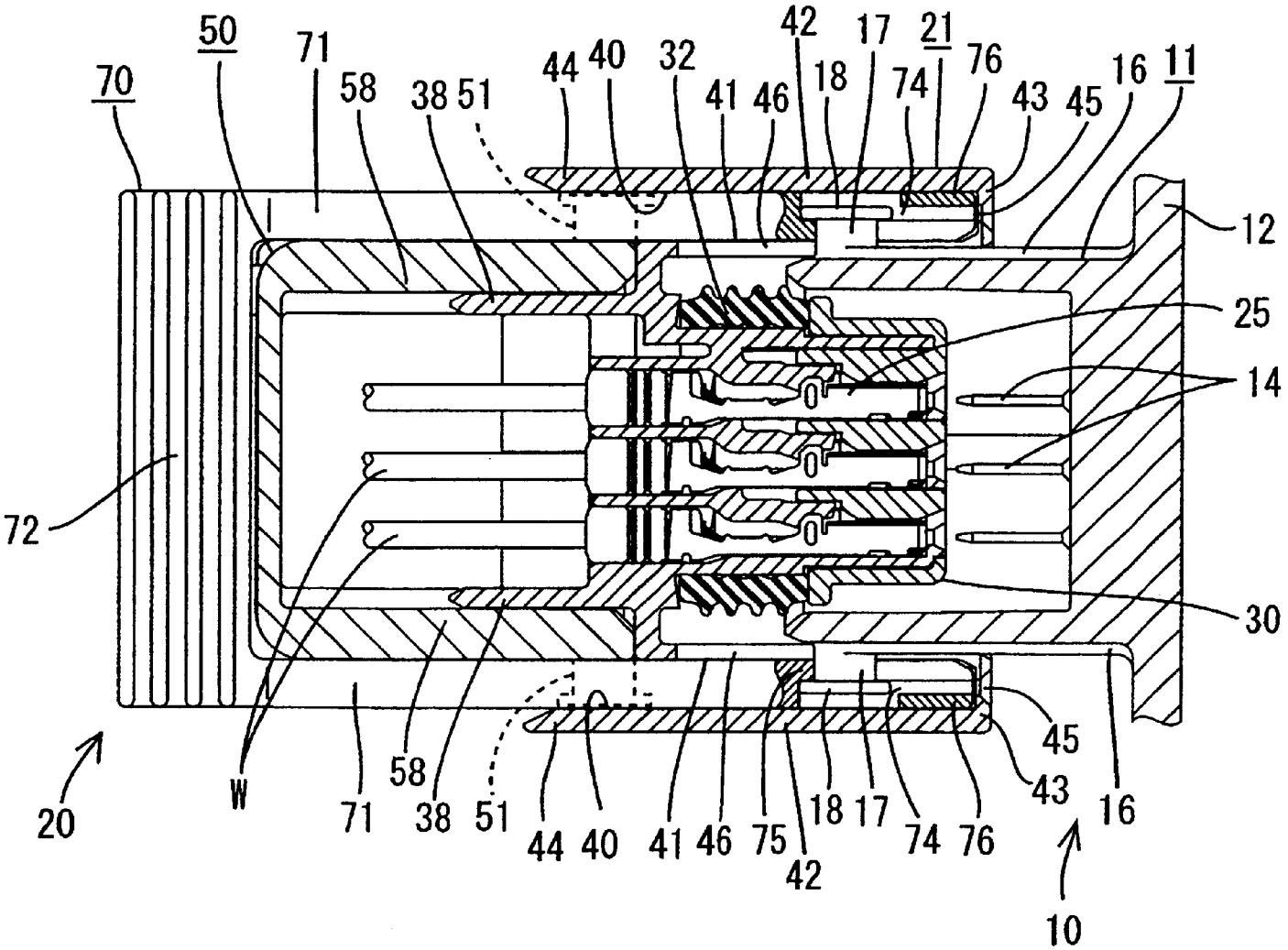
FIG. 15 is partly cutout side view showing the initial state in fitting both connectors on each other.

After the female connector 20 is assembled from the lever 70 and the cover 50, the female connector 20 is fitted on the male connector 10. The male-side hood 13 of the male connector 10 is penetrated between the terminal accommodation portion 22 of the female connector 20 and the female-side hood 23 thereof. As shown in FIG. 14, after the follower pin 17 passes the introduction opening 45 of the reinforcing wall 43, the female connector 20 is fitted on the male connector 10 to such an extent that the follower pin 17 penetrates into the entrance of the cam groove 74. At this time, as shown in FIG. 15, the lever 70 is sandwiched between the accommodation wall 42 and the wall 41. Hence, the entrance of the cam groove 74 and the introduction opening 45 of the reinforcing wall 43 match each other without a vertical dislocation. Accordingly, the operation of penetrating the follower pin 17 into the cam groove 74 from the introduction opening 45 can be performed smoothly.

A force on the lever 70 in the direction indicated with an arrow of FIG. 14 will unlock the first holding projection 52 from the holding hole 77. Thus the lever 70 will rotate from the initial position. Rotation of the lever 70 causes the follower pin 17 to move inward of the cam groove 74, as shown in FIG. 16. Thus both connectors 10 and 20 are moved in a direction in which they are fitted on each other to a high extent.

Figure 17:
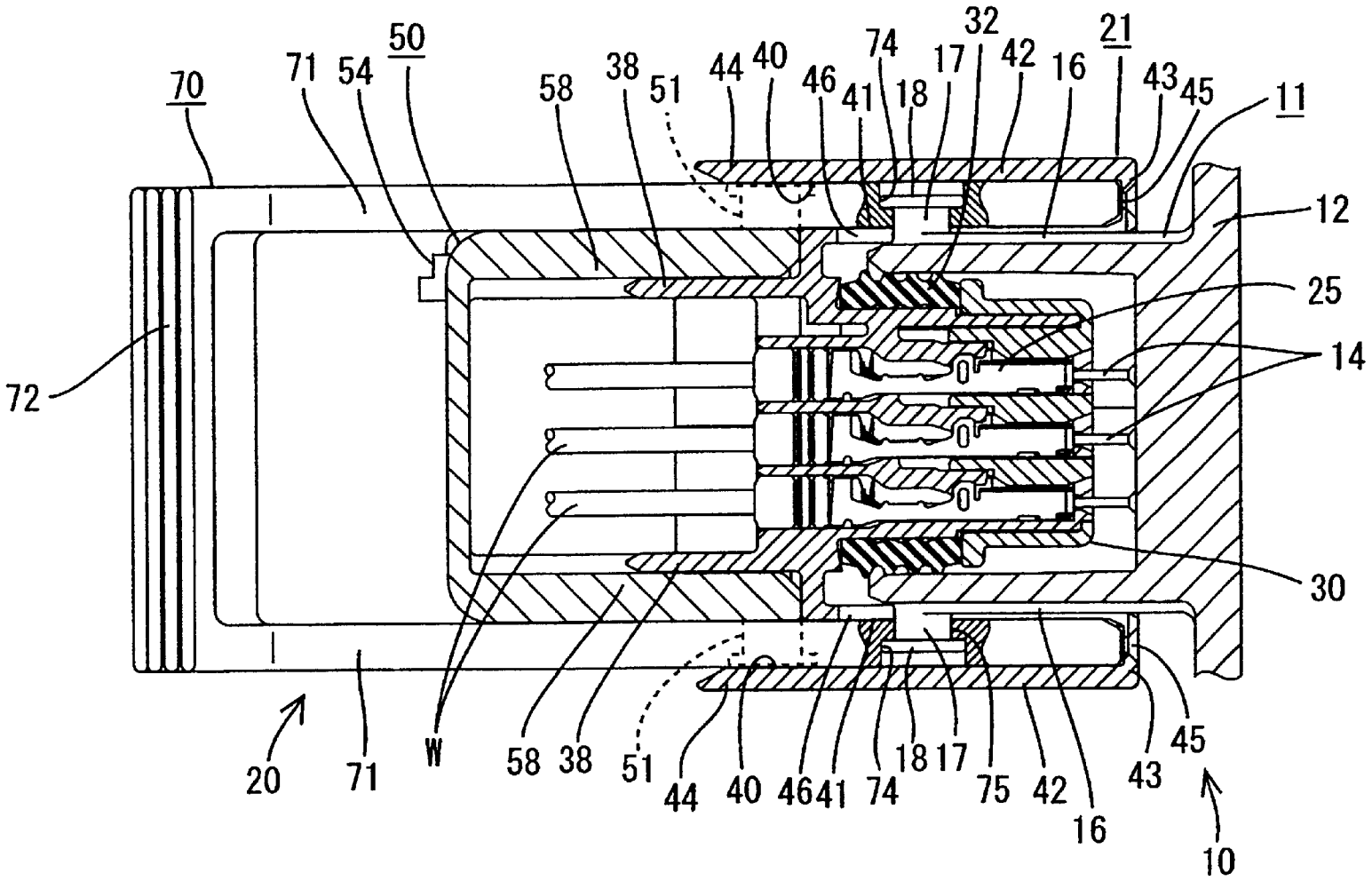
FIG. 17 is partly cutout side view showing a state in which both connectors are being fitted on each other.

When the lever 70 is rotated, a force of opening both legs 71 outward around the shaft construction portion is applied to the lever 70. However, as shown in FIG. 17, the leg 71 is sandwiched between the accommodation wall 42 and the wall 41 without forming a gap therebetween. Further, the force acting on the leg 71 can be received by the accommodation wall 42 and the extended wall 44 disposed outside the shaft construction portion. Thus, it is possible to prevent the lever 70 from being deformed outward, and it is possible to prevent the lever 70 from slipping off the cover 50. Further, because the front end of the accommodation wall 42 is continuous with the wall 41 through the reinforcing wall 43, the accommodation wall 42 is strong enough to receive the force applied by the lever 70.

The force acting on the lever 70 in the direction in which the legs 71 are opened outward also acts on the cover 50 installed on the lever 70. The direction of the force acting on the cover 50 is the same as the direction in which the locking piece 57 and the locking projection 35 are unlocked from each other. Thus, if the cover 50 is opened and deformed by the applied force, there is a possibility that the cover 50 slips off the female housing 21. As shown in FIGS. 8 and 9, the side surface of the engaging projection 39 of the female housing 21 engages the periphery of the engaging groove 60 of the cover 50. Thus, the force acting on the cover 50 in the direction in which it is opened outward can be received between the cover 50 and the female housing 21. Accordingly, it is possible to prevent the cover 50 from being opened and thus prevent the cover 50 from slipping off the female housing 21. Further, the engaging groove 60 and the engaging projection 39 are disposed directly inward from the rotational shaft, of the lever 70, on which the force is applied at a highest degree during its rotation, thus receiving the force. Thus, it is possible to effectively prevent the cover 50 from being opened.

Figure 19:
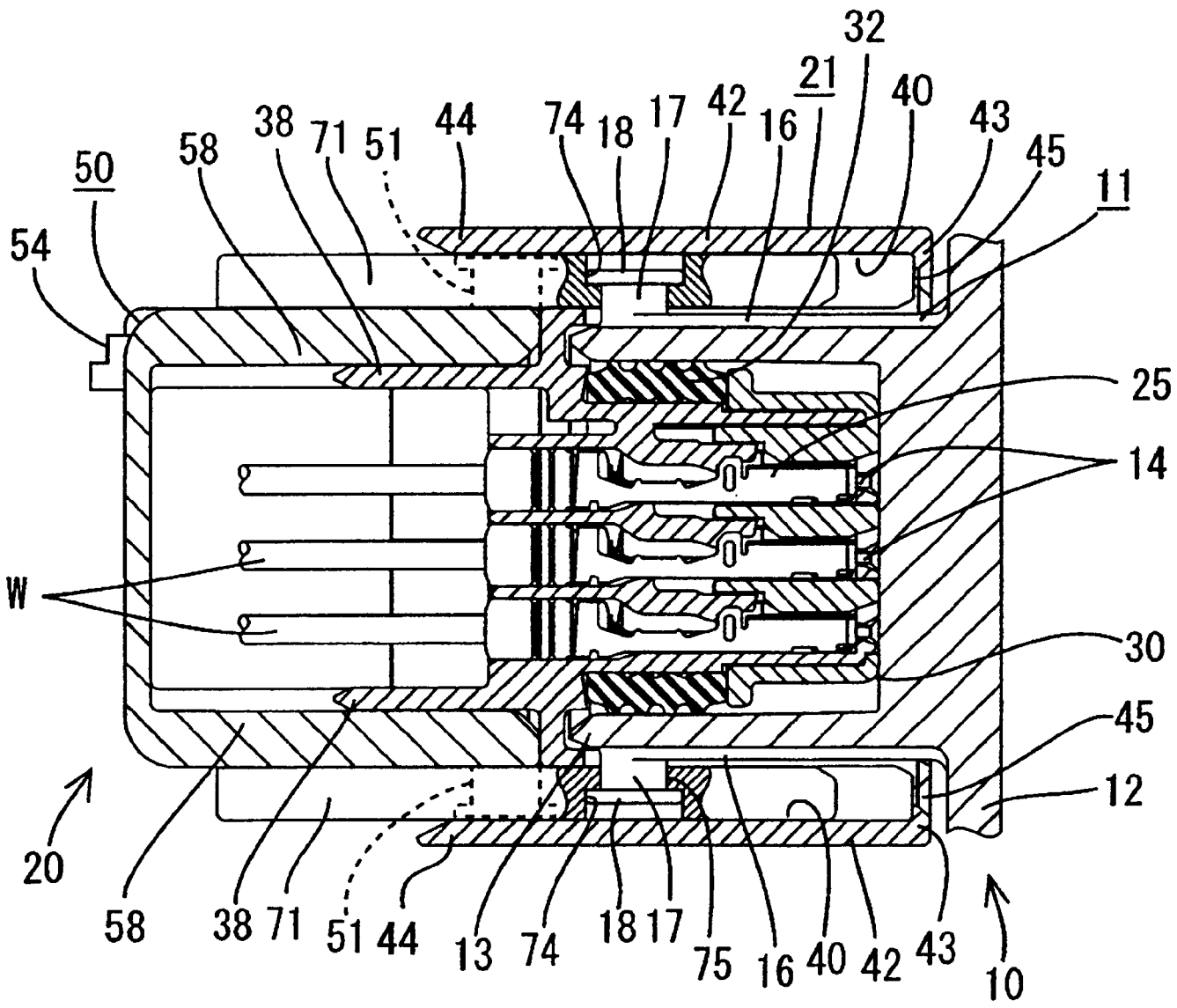
FIG. 19 is partly cutout side view showing a state in which both connectors have been normally fitted on each other.

When the lever 70 is rotated to the completion position, as shown in FIG. 18, the follower pin 17 reaches the termination of the cam groove 74, and both connectors 10 and 20 are fitted on each other in a normal extent. At this time, the second holding hole 79 of the lever 70 is locked to the second holding portion 55 of the cover 50. Thus, the lever 70 is held unrotatably in the completion position. Therefore, both connectors 10 and 20 are held unseparably from the normal fit-on state. At this time, as shown in FIG. 19, the male and female terminal fittings 14 and 25 are electrically conductively connected to each other, and the hood 13 of the male housing 11 contacts the peripheral surface of the seal ring 32 closely, thus waterproofing the gap between both connectors 10 and 20.

When both connectors 10 and 20 are separated from each other for maintenance or the like, the lever 70 placed at the completion position is rotated in the direction opposite to the direction in which the lever 70 is rotated in the connector fit-on operation. Rotation of the lever 70 moves the follower pin 17 to the entrance of the cam groove 74, and thus both connectors 10 and 20 move in the separation direction. When the lever 70 is rotated to the initial position, the follower pin 17 reaches the entrance of the cam groove 74, and the entrance of the cam groove 74 and the introduction opening 45 of the reinforcing wall 43 match each other. Both connectors 10 and 20 are separated from each other in this state. In removing the cover 50 from the female connector 20, as shown in FIG. 10, a release jig is inserted into the jig insertion groove 36 and a removal operation is performed, with the jig applied to the rear end surface of the female-side hood part 23. As a result, the lever action of the jig enables the locking piece 57 to be flexed and unlocked from the locking projection 35.

As described above, the lever 70 accommodated in the lever accommodation space 40 is sandwiched between the wall 41 and the accommodation wall 42 without forming a gap therebetween. Therefore, it is possible to correct the inwardly warped lever 70 and to prevent the lever 70 from being opened during its rotation. Further, in installing the cover 50 on the female housing 21 after the shaft 51 of the cover 50 is fitted in the shaft hole 73 of the lever 70, the lever 70 is accommodated in the lever accommodation space 40. Thus, the lever 70 can be mounted on the female housing 21 easily.

Furthermore, the wall 41 and the accommodation wall 42 sandwiching the lever 70 are continuous with each other at the front ends thereof through the reinforcing wall 43. Thus, the accommodation wall 42 has a high strength. In a connector having many poles, an accommodation wall is necessarily long. Consequently, the accommodation wall is apt to have a low strength. In this respect, the present invention is particularly effective for such a connector.

The technical scope of the present invention is not limited to the above-described embodiment, but the following embodiments are included in the technical scope of the present invention. In addition to the following embodiments, the present invention can be embodied by varying it in various modes without departing from the gist of the present invention.

In the above-described embodiment, the wall and the accommodation wall are continuous with each other through the reinforcing wall. However, if the connector has a comparatively small number of poles and if the accommodation wall has an insufficient strength, the formation of the reinforcing wall may be omitted. The present invention includes such a construction.

What is claimed is:

1. A lever-type connector comprising:

a first connector housing having a front end and a first hood projecting rearwardly from the front end, oppositely directed followers projecting from said first hood;

a second connector housing having opposite front and rear ends and a second hood extending rearwardly from said front end, said second hood being dimensioned to slidably receive said first hood, said second hood having guide grooves extending rearwardly from the front end of the second connector housing, for slidably receiving said followers;

a cover being mounted to the rear end of the second connector housing;

a lever having substantially parallel legs mounted rotatably to the cover, portions of said legs projecting forwardly from said cover and being slidably engaged against outer surface portions of said second hood; each said leg having a cam groove engageable with one of said followers, such that rotation of said lever relative to said cover moves said followers in said guide grooves and moves said first and second connector housings relative to one another;

accommodation walls being formed on outer walls of said second connector housing and substantially adjacent outer surface portions of said legs of said lever, such that said accommodation walls substantially abut said legs for covering and protecting said cam grooves and said guide grooves.

2. The lever-type connector of claim 1, further comprising inclined guide portions substantially adjacent said rear end of said second connector housing for guiding said legs of said lever into accommodation spaces defined between the respective second hood and the accommodation walls.

3. The lever-type connector of claim 1, wherein the accommodation walls are formed unitarily with said second connector housing.

4. The lever-type connector of claim 3, further comprising reinforcing walls substantially at said front end of said second connector housing and extending unitarily between said second hood and one of said accommodation wall.

5. The lever-type connector of claim 4, wherein each said reinforcing wall has an opening aligned with one of said guide grooves, whereby portions of said followers can be passed slidably through the opening in the reinforcing wall.

6. A connector housing assembly comprising a hood defined by a plurality of outer walls and forming a forwardly open mating receptacle subtended by said outer walls, a rearwardly open accommodation space surrounding said outer walls, at least two guide grooves extending through at least two of said outer walls of said hood, said guide grooves extending rearwardly from said front end of said second connector housing and providing communication between said receptacle and said accommodation space;

a cover mounted to said rear end of said connector housing and a lever having a pair of legs mounted rotatably to said cover, said legs each being formed with a cam groove, portions of said legs having said cam grooves being slidably engaged in said accommodation space such that portions of said cam grooves in said legs align with said guide grooves for all rotational positions of said lever.

7. The lever-type connector assembly of claim 6, wherein each said cam groove has an open ended entry, said entry being disposed adjacent said front end of said connector housing and being aligned with said guide groove when said lever is rotated a maximum amount in a first direction on said connector housing.

8. A method for assembling a lever-type connector, said method comprising:

providing a connector housing having opposite front and rear ends and a plurality of terminal receiving cavities extending between said front and rear ends, a plurality of outer walls surrounding said terminal receiving cavities and a rearwardly open accommodation space surrounding said outer walls;

mounting assemblies of terminal fittings and wires into said terminal receiving cavities such that the wires of said assemblies project from said rear end of said connector housing;

providing a rear cover for covering portions of said rear end of said connector housing and guiding said wires in a selected direction;

providing a lever for facilitating mating of said connector housing with another connector housing;

mounting said lever rotatably on said cover such that portions of said lever project forwardly beyond said cover;

mounting said cover to said rear end of said connector housing, such that portions of said lever that extend forwardly from said cover are moveably disposed in the accommodation space of said connector housing.

* * * * *